United States Patent [19]

Vila-Masot

[11] Patent Number: 4,760,384

[45] Date of Patent: Jul. 26, 1988

[54] LIGHT-EMITTING DIODE INDICATOR CIRCUIT

[76] Inventor: Oscar Vila-Masot, Complejo Turistico "El Morro" , Puerto La Cruz, Venezuela

[21] Appl. No.: 29,009

[22] Filed: Mar. 23, 1987

Related U.S. Application Data

[63] Continuation-in-part of Ser. No. 654,156, Sep. 25, 1984, Pat. No. 4,652,867, which is a continuation-in-part of Ser. No. 22,713, Mar. 16, 1987.

[51] Int. Cl.[4] ..... G08B 21/00

[52] U.S. Cl. ..... 340/638; 340/691; 335/17; 337/79

[58] Field of Search ..... 340/638, 639, 644, 649, 340/652, 654, 656; 335/6, 17; 337/79, 241, 206

[56] References Cited

U.S. PATENT DOCUMENTS 3,452,347 6/1969 Stimson ..... 340/691

4,652,867 3/1987 Masot ..... 340/691 X

*Primary Examiner*—Joseph A. Orsino

*Assistant Examiner*—Jeffery A. Hofsass

*Attorney, Agent, or Firm*—Hoffman, Wasson & Fallow

[57] ABSTRACT

An indicator circuit used primarily, but not exclusively, within a conventional circuit breaker. The indicator circuit consists of a light-emitting diode and a capacitor connected in series and provided on the neutral line of the circuit breaker. The circuit is connected in series with the main breaker switch and the light-emitting diode is energized when the circuit breaker is in the ON position. Alternatively, this indicator circuit can be used to determine the operational status of various load devices.

9 Claims, 2 Drawing Sheets

LIGHT-EMITTING DIODE INDICATOR CIRCUIT

This application is a continuation-in-part of U.S. patent application Ser. No. 654,156, now U.S. Pat. No. 4,652,867 filed Sept. 25, 1984, and is a continuation-in-part application of Improved Circuit Breaker Indicator application, filed Mar. 6, 1987, application Ser. No. 22,713.

BACKGROUND OF THE INVENTION

Conventional circuit breakers are usually placed in operative position either singly or in banks of side-by-side units. These units can contain a handle which protrudes from the circuit breaker or a plurality of switches which are provided within the casing. In either situation, the handle is provided in two extreme positions and a single intermediate position. When the load circuit directly connected to the circuit breaker is overloaded, the circuit blows which causes the operating handle to move from the ON extreme position to the intermediate position as well as interrupting the current conducted to the load cicuit. When a number of such circuit breakers are in a group, as they conventionally are, it is difficult to ascertain which circuit breaker has its handle or switch in a blown position, particularly since most circuit breakers are in cellars or similar dimly-lit locations. Additionally, even when the circuit breakers are in brightly lit areas, it is often difficult to determine the particular circuit breaker which has blown. This, of course, is important since, when an overload occurs and the circuit is blown, it must be found and corrected before resetting the circuit breaker by moving the operating handle or switch to the OFF extreme position before it can be moved to the ON position.

U.S. Pat. No. 4,056,816 issued to Raul Guim discloses an illuminated circuit breaker utilizing a light-emitting diode to indicate when the circuit breaker has blown. This diode is provided in a circuit parallel to the main switch of the circuit breaker which includes a resistor in series with the light-emitting diode. However, a difficulty experienced by the device disclosed in the Guim patent is the limitation of the maximum voltage potential which it can withstand. Surge conditions on a public network, or those created artificially by testing laboratories to simulate possible surges in the public network, require these devices to withstand up to 1500 volts, when tripped. Under this tripped condition, any high voltage appearing across the circuit breaker will actually be applied to the load in series with the light-emitting diode and the resistor which is utilized as a voltage reducing element. Since the impedance of the light-emitting diode and the resistor is typically around 25,000 ohms, all of the surge voltage will appear across this resistor during the half-cycle when the light-emitting diode is conducting, since the impedance is several times larger than that of the load.

Thus, the resistor which is utilized in the Guim patent must have a rating of several watts because of its heat dissipation in an environment with virtually no ventilation and lack of heat conduction paths to the outside of the circuit breaker. Additionally, the resistor must be of a sufficient length to withstand the voltage gradient that will be present along the length of the resistor. Because of the space limitations of the circuit breaker, it is absolutely impossible to place such a resistor therewithin, and the conventional resistors which are utilized will crack due to high temperature, arcing or a combination of both.

SUMMARY OF THE INVENTION

The present invention overcomes all of the difficulties of the prior art by providing an illuminated indictaor circuit for conventional circuit breakers which protect against abnormal surge voltages when blown by an overload or when tested under simulated similar conditions. This circuit utilizes a reactive element such as a capacitor which is placed in series with a light-emitting diode. This indicating circuit is connected in parallel with the main switch of the circuit breaker. When the circuit breaker is blown, a moving contact moves away from a fixed contact due to the operation of a thermoelectric or magnetic tripping element. This movement opens the circuit between a line terminal and the circuit load. Simultaneously, the circuit which is parallel to the main switch and includes the capacitor and the light-emitting diode is connected between the line terminal and the circuit load. At this point, the light-emitting diode is illuminated and it can easily be determined which of a plurality of circuit breakers has blown. In this situation, the voltage across the light-emitting diode is greater than the reverse breakdown voltage of the light-emitting diode.

Alternatively, the illuminated indicator circuit including the light-emitting diode and the capacitor is provided in a circuit whereby the light-emitting diode is energized when the circuit breaker toggle is in the ON position but is de-energized when the circuit breaker toggle is in the OFF or TRIPPED positions.

Additionally, the teachings of the present invention can be extended to ordinary household appliances or similar devices which would include a lighting source, such as a light-emitting diode which would be energized when the device is receiving line current, but would be de-energized when no current is being received.

The above and other objects, features and advantages of the present invention will become more apparent from the following description thereof taken in conjunction with the accompanying drawings.

DETAILED DESCRIPTION OF THE INVENTION

Figure 1:
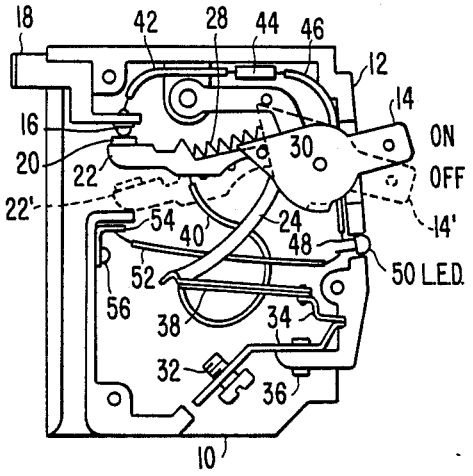
FIG. 1 is a cross-section view of a conventional circuit breaker incorporating the indicator circuit of the present invention.
Figure 2:
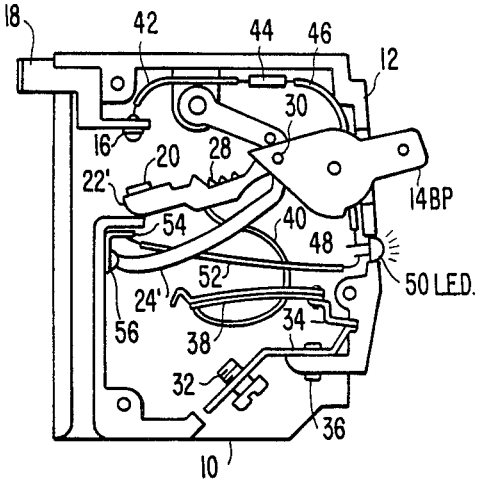
FIG. 2 is a cross-section view of a conventional circuit breaker incorporating the indicator circuit of the present invention after the circuit breaker has blown.
Figure 3:
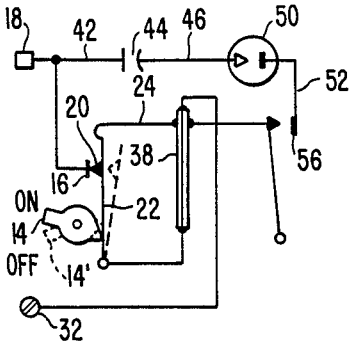
FIG. 3 is a diagram of the circuit shown in FIG. 1 in both the ON and OFF positions.
Figure 4:
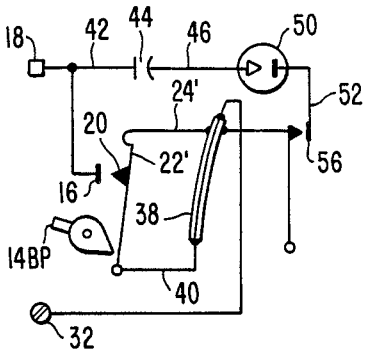
FIG. 4 is a circuit diagram of the circuit breaker shown in FIG. 2.

As shown in FIGS. 1 and 2, a standard thermoelectrically activated circuit breaker is provided in a housing or case 10 of suitable insulating material. The cover or face of the circuit breaker is omitted from the drawings to enable the interior parts therein to be illustrated. Although it is not important for this particular invention, the case and cover are typically manufactured from a molded, insulating plastic. A handle 14 is provided which extends through a portion of the housing 12. As shown in FIG. 1, the handle 14 is depicted in the ON position by the solid lines, and in the OFF position 14' as shown by the phantom lines. Additionally, FIG. 2 shows the handle 14 in the blown position.

A fixed contact 16 is mounted on a line terminal clip 18 which is designated to engage a line bus when the circuit breaker is inserted into a distribution panel, often provided in a dark or dimly-lit location. A movable contact 20 is mounted on a contact carrier 22.

A trip arm 24 is pivoted on a boss 26 within the case 10 for pivoting between the ON position shown in FIG. 1 and the tripped position shown in FIG. 2. An overcenter tension spring 28 having one end connected to the contact carrier 22 and the other end connected to the trip arm 24 is also provided. The handle 14, contact carrier 22 and spring 28 form an overcenter arrangement, or toggle, which serves as the operating mechanism for urging the movable contact 20 towards the fixed contact 16 when the spring 28 is on one side of a pivot point 30, as shown in FIG. 1, and urging the movable contact 20 to the open position when the spring 26 is on the other side of the pivot point 30, as shown in FIG. 2.

A load terminal connecting screw 32 for connecting the circuit breaker to a load circuit is positioned within the molded case 10. This screw is threaded through a bus bar 34 riveted or screwed in the case 10 at 36.

A thermally-responsive latching member 38 is electrically connected to the movable contact 22 by a flexible conductor 40 typically of copper-stranded wire. This thermally-responsive member 38 is generally a hook-shaped, bimetallic theromstat element having at least two layers of metal provided with differing coefficients of thermal expansion such that the element bends as it is subjected to increased temperature. One end of the flexible conductor 40 is directly attached to one end of the bimetallic member 38 and its other end is connected to the contact carrier 22. The other end of the bimetallic member is connected therough the bus bar 34 to the terminal load screw 32.

A light-emitting diode 50 is provided in a circuit parallel with the main switch of the circuit breaker provided between the line terminal clip 19 and the load terminal screw 32. An insulated conductor 42 is connected at one end to the back of the line terminal clip 18 and at its other end to a current-limiting capacitor 44. The capacitor 44 is in turn connected through a conductor 46 to one side 48 of the light-emitting diode 50. This diode is countersunk in the case edge 12 such that it is prominently visible. The second side of the light-emitting diode 50 is connected by a conductor 52 to an arm 54 having a contact 56 thereon. The contact 56 provides an electric connection to the trip arm 24 when the arm has been tripped to the position 24', as shown in FIG. 2. The current then passes through the trip arm 24' to the contact carrier 22 shown in position 22'. The current then moves from the contact carrier 22 through the conductor 40 to the bimetallic element 38 and thus through the bus bar 34 to the load terminal screw 32 to which the load is normally connected.

As is known in the prior art, the circuit breaker operates in a customary manner for opening and closing contacts and also for tripping under an overload condition. Although it is not imperative for the present invention, conventional circuit breaker construction is shown in U.S. Pat. No. 3,930,211. For example, during normal conditions, the hook-like member at the end of the thermally-responsive member 38 maintains the trip arm 24 in a position away from the contact 56. However, when subjected to an overload condition, the thermally-responsive member 38 bows outward due to its bimetallic nature, releasing the trip arm 24 to contact the contact 56.

Figure 5:
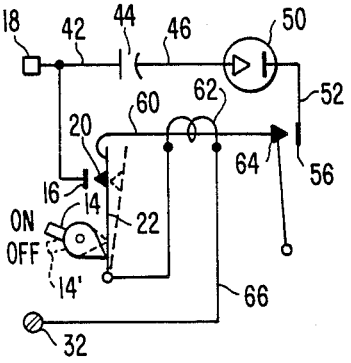
FIG. 5 is a circuit diagram of a magnetic circuit breaker in both the ON and OFF positions.
Figure 6:
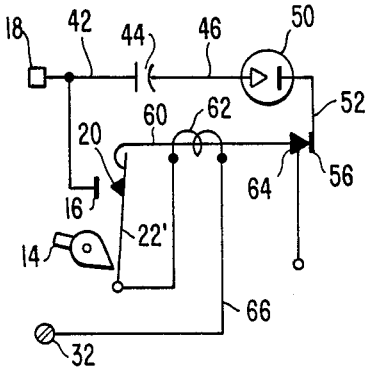
FIG. 6 is a circuit diagram of FIG. 5 after the circuit breaker has blown.

FIGS. 5 and 6 show circuit diagrams of the operation of a magnetic circuit breaker which is similar in many respects to the thermoelectric circuit breaker illustrated in FIGS. 1–4. Consequently, the same reference numbers utilized in FIGS. 1–4 will be utilized with respect to FIGS. 5 and 6. In this situation, an armature 60 is provided which extends through a magnetic coil 62. This armature and magnetic coil are substituted for the trip arm 24 and the bimetallic latching element 38 shown in FIGS. 1–4. The armature 60 also electrically connects the contact carrier 22 to a contact 64 after the load circuit is blown. The armature 60 then completes the circuit through contact 56 to connector 52 and the light-emitting diode 50. When an overload is sensed, the armature 60 pulls the contact carrier 22 to move its contact 20 away from the fixed contact 16 and moves contact 64 into the circuit completing position with contact 56, as is shown in FIG. 6. This movement causes the circuit from the line bus 18 to pass through the connector 42 through capacitor 44 to conductor 46 and the light-emitting diode 50. Consequently, the light-emitting diode 50 is activated and remains lit. The circuit path then continues through the armature 60, through contact carrier 22 and through the magnetic coil 62 and connector 66, to the load terminal screw 32.

In operation, the handle 14 operates contact carrier 22 to make or break the circuit through contact 16 and bus bar terminal 18. When an overload is sensed in the circuit shown in FIGS. 1–4, the circuit from the contact 16 to the contact carrier's contact 20 is broken by the movement of the bimetallic member 38 and the trip arm 24 moving to position 24'. This movement completes a circuit from conductor 52 through contact carrying arm 54 and contact 56 thereby completing the parallel circuit including the light-emitting diode 50 which remains lit until the handle 14 is operated upon to reconnect the circuit breaker. Similarly, when a overload is sensed by the magnetic circuit breaker shown in FIGS. 5 and 6, the load circuit is interrupted by the coil 62 moving the armature 60 to interrupt the load circuit between the fixed contact 16 and the movable carrier contact 20. This movement completes the circuit between the armature contact 64 and the diode contact 56 to activate the light-emitting diode and keep it lit until the handle 14 is acted upon to close the circuit breaker.

Utilizing both the thermoelectrically operated circuit breaker shown in FIGS. 1–4 and the magnetic circuit breaker shown in FIGS. 5 and 6, when an overload is sensed, the reactive current limiting capcaitor 44 will generally have an impedance many times greater than the impedance of the load. Therefore, the majority of the AC voltage provided by the bus line will be applied across the parallel indicator circuit provided with capacitor 44. Since a capacitor and not a resistor is utilized as the current-limiting device, no heat generation problem exists. Additionally, the particular capacitor must have a high dielectric breakdown voltage such as provided by ceramic capacitors.

The small current that flows in the circuit including the capacitor 44 is used to illuminate the light-emitting diode 50. To insure that the circuit breaker operates safely, and to adhere to Underwriters Laboratories (U.L.) and Canadian Standards Association (C.S.A.) requirements, the current should be less than 500 microamps and 120 volts. Therefore, it becomes crucial that the proper selection of the capacitor 44 and the light-emitting diode 50 be made such that the safety requirements are followed as well as providing sufficient current to illuminate the light-emitting diode 50. Furthermore, the circuit breaker must adhere to an additional U.L. and C.S.A. mandate of withstanding a dielectric test including a test in the TRIP position. This test requires that the circuit breaker withstand 1500 volts for one minute without exceeding the maximum current of five milliamps.

When the circuit breaker is in the TRIP position, 120 volts R.M.S. appears across the circuit including the line terminal clip 18 and the load terminal 32. Since the light-emitting diode 50 is essentially a diode, the voltage drop across it will be typically 1.5 volts and the brightness generated by the light-emitting diode 50 is controlled by the amount of current I flowing therethrough. Since the light-emitting diode 50 is also acting as a rectifier allowing the current I to flow in one direction and blocking the current from flowing in the opposite direction, current flow to the light-emitting diode must be great enough to allow illumination while insuring that the maximum current requirements for safety are not exceeded. Hence, the value of capacitor 44 must be properly chosen since this capacitor acts as a current limiter by dropping voltage across it. In this situation, the voltage is charged through the alternating current source which energizes the circuit during the positive half-cycle during which time the light-emitting diode is illuminated. The capacitor is discharged during the negative half-cycle of the alternate current through the light-emitting diode when the voltage across the light-emitting diode exceeds the reverse breakdown voltage of the light-emitting diode. If the voltage across the light-emitting diode does not exceed the reverse breakdown voltage during the negative half-cycle, the capacitor will not discharge and further illumination of the light-emitting diode will cease.

If the voltage E is 120 volts R.M.S. and the maximum current $I_{max}$ is 500 microamps and the power line frequency is 60 hertz, the reactance of this circuit $X_c$ can be calculated using the formula:

$$X_c = \frac{E}{I}$$

$$X_c = \frac{120}{500 \times 10^{-6}}$$

$$X_c = 2.4 \times 10^5 \text{ ohms}$$

Therefore, since $$C = \frac{1}{2\pi f X_c}$$

-continued $$C = \frac{1}{2\pi(60)(2.4 \times 10^5)}$$

then $$C = 11{,}000 \text{ picofarads}$$

The value of the capacitance of 11,000 picofarads was calculated using the maximum current of 500 microamps. Adding a margin of safety, it was determined that a capacitance of 6,800 picofarads would adequately serve the present invention. Therefore, since $$X_c = \frac{1}{2\pi f_c}$$

$$X_c = \frac{1}{2\pi(60)(6800 \times 10^{-12})}$$

$$X_c = 390 \text{ Kilohm}$$

and $$I = \frac{E}{X_c}$$

$$I = \frac{120}{390 \times 10^3}$$

$$I = 300 \times 10^{-6} \text{ amps}$$

a current of 300 microamps yielding a safety margin of 40% is produced. This current has been determined to be sufficient to illuminate the light-emitting diode used in the present circuit.

As previously indicated, this particular circuit must also withstand the dielectric test of 1500 volts. Therefore $$I = \frac{E}{X_c}$$

$$I = \frac{1500}{390 \times 10^3}$$

$$I = 3.8 \times 10^{-3} \text{ amps}$$

The value of I equals $3.8 \times 10^{-3}$ amps or 3.8 milliamps which is significantly lower than the 5 milliamp breakdown requirement.

Hence, based upon the calculations provided herein, a capacitor having a value of 11,000 picofarads can be used as long as the previously discussed electrical requirements are satisfied. Since the maximum current is 0.5 milliamps at E=1500 volts, then $$X_c = \frac{E}{I}$$

$$X_c = \frac{1500}{5 \times 10^{-3} \text{ amps}}$$

$$X_c = 300 \text{ Kilohms}$$

Therefore $$C = \frac{1}{2\pi f X_c}$$

-continued $$C = \frac{1}{2\pi(60)(3 \times 10^5)}$$

$C = 8840$ picofarads

While the physical size of present day circuit breakers precludes a capacitor whose value is greater than 6800 picofarads, a capacitor whose value is 8840 picofarads could in theory be utilized and still pass the U.L. and C.S.A. tests. A capacitor which could be used is an "across-the-line" type capacitor having a rating of 300 volts AC and 2,000 volts D.C. This capacitor is epoxy coated to withstand the extreme conditions to which the circuit breaker is subjected.

A multitude of light-emitting diodes could be used in the present invention. However, the Oshino #OLR140; Lite-On #LT-5214; Lumex #SSL-LX-5063HT and Toshiba #TLR-140 have been found to be the most reliable. These light-emitting diodes typically exhibit a reverse breakdown voltage of between three and four volts, a voltage which is exceeded during the negative half-cycle of the alternating current source thereby allowing the capacitor to discharge and the light-emitting diode to illuminate. However, please note that the exact reverse breakdown voltage is immaterial as long as the voltage across the light-emitting diode exceeds this breakdown voltage at least during the negative half-cycle of the alternating current source.

Figure 7:
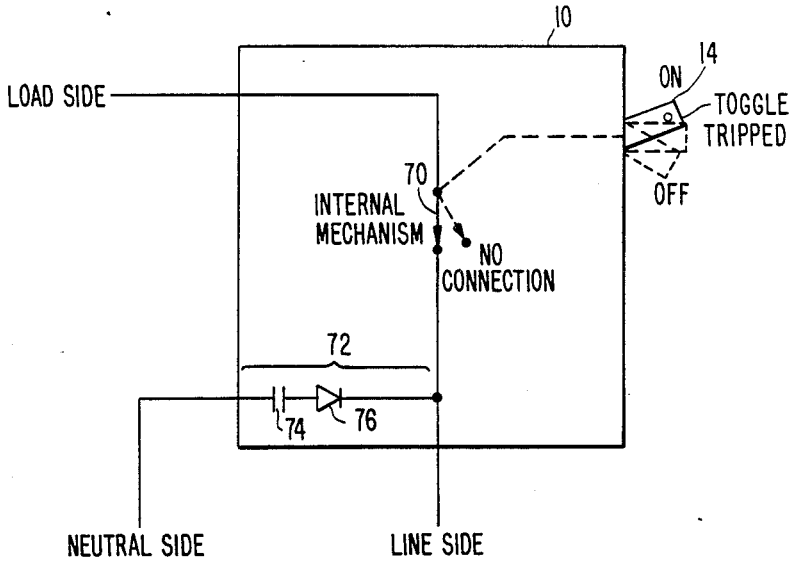
FIG. 7 is a diagram of an alternative embodiment of the indicator circuit used with a circuit breaker.

An alternate embodiment of the present invention is shown in FIG. 7. It should be noted that with the exception of the placement of the indicator circuit within the circuit breaker housing, the internal mechanism of the circuit breaker as illustrated in FIGS. 1 and 2 remains the same and therefore for the sake of clarity the internal mechanism is not duplicated in this Figure.

The invention described with respect to FIGS. 1–6 includes an indicator circuit provided with a light-emitting diode energized when the circuit breaker toggle 14 is in the OFF or TRIPPED positions and is de-energized when the toggle is in the ON position. The indicator circuit shown in FIG. 7 is energized when the circuit breaker toggle 14 is in the ON position, but is de-energized when the circuit breaker toggle is in the OFF or TRIPPED positions. This indicator circuit including capacitor 74 and light-emitting diode 76 is provided on the neutral line of the circuit breaker and is connected to the load side of the main circuit breaker switch 70. When the circuit breaker toggle is in the ON position as shown in solid lines, current flows in the circuit breaker from the terminal or line side to the load side through the closed position of the switch 70. Simultaneously, a portion of the current is diverted to the neutral line, thereby energizing the light-emitting diode 76. When the circuit breaker toggle switch 14 is in the OFF or TRIPPED positions, as shown in phantom, no current flows through the main switch 70 to the load side and therefore no current will be diverted to the indicator circuit and the diode 76 is de-energized.

Figure 8:
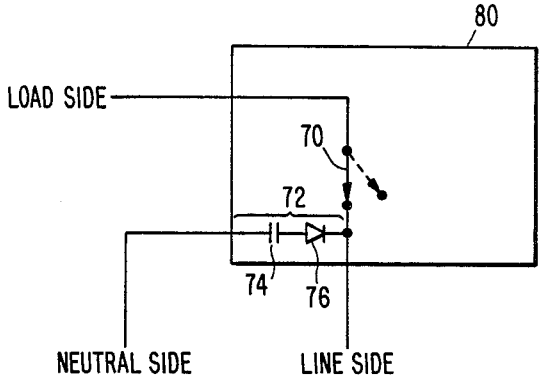
FIG. 8 is a diagram showing the use of the indicator circuit of FIG. 7 is a non-circuit breaker environment.

FIG. 8 applies the indicator circuit shown in FIG. 7 to a non-circuit breaker environment. Typically, this invention can be extended to household appliances such as a steam iron, hand drill or similar devices which utilize threeprong plugs. When the device is plugged in and switch 70 is activated, the light-emitting diode 76 would be energized to indicate that current is flowing in the line side of the circuit and that the appliance is operational.

Figure 9:
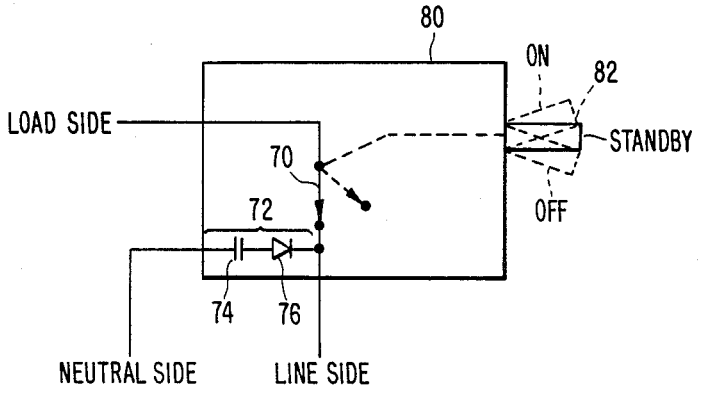
FIG. 9 is an alternative embodiment of the invention shown in FIG. 7.

FIG. 9 shows a variation of the device illustrated in FIG. 8. When switch 82 is in the ON position, device 80 would be activated, and when switch 82 is in the STANDBY position, device 80 is connected to the line source and is capable of operation if the switch 82 is moved to the ON position. In both of these instances, switch 70 connects the load side to the line side in the manner described with respect to FIG. 7 and the light-emitting diode 76 will be energized. However, when the switch 82 is in the OFF position, as shown in phantom, the light-emitting diode will be de-energized.

Many changes and modifications in the above embodiments of the invention can, of course, be made without departing from the scope of the invention. For example, it is apparent that the circuit breaker which is utilized with the parallel indicating circuit is not to be construed to be limited to the circuit breaker shown and described hereinabove and various similarly constructed and operated circuit breakers can be utilized. Additionally, although it is indicated that a light-emitting diode is utilized as the illumination means of the indicator circuit, other illuminating devices such as liquid crystals or electrophoretic indicating means could be employed. Furthermore, although this invention has been described with respect to a single circuit breaker, a series of side-by-side circuit breakers having illuminating devices associated singly with each circuit breaker is envisioned within the scope of the invention.

What is claimed is:

1. In a conventional circuit breaker provided with a first fixed contact connected to an input terminal, a movable contact provided on a contact arm movable between a closed position directly contacting said first fixed contact and an open position away from said first fixed contact, a load terminal connected to a load through said first fixed and said movable contact during normal operation and disconnected from said first fixed contact during overload operation, sensing means for sensing the presence of an overload condition across the circuit breaker, said sensing means connected to said load terminal, a neutral line connected in series with said load terminal, and a tripping means sensitive to the movement of said sensing means, said tripping means acting to contact a second fixed contact when said sensing means senses an overload condition, the improvement comprising:

an indicator circuit provided in said neutral line and in series with said input terminal and said load terminal and in parallel with said second fixed contact and said tripping means, said indicator circuit including a light-emitting diode connected in series to a capacitor, wherein said light-emitting diode device is energized when an overload condition is not sensed.

2. The circuit breaker in accordance with claim 1, wherein said sensing means is a thermally activated bimetallic element.

3. The circuit breaker in accordance with claim 1, wherein said sensing means is magnetically activated.

4. A circuit breaker comprising:

A first fixed contact;

an input terminal connected to said first fixed contact;

a movable contact provided on a contact arm, movable between a closed position directly contacting said first fixed contact and an open position away from said first fixed contact;

a load terminal connected to a load through said first fixed contact and said movable contact during normal operation and disconnected from said first fixed contact during overload operation;

a neutral line connected in series with said load terminal;

sensing means for sensing the presence of an overload condition across the circuit breaker, said sensing means connected to said load terminal;

tripping means sensitive to the movement of said sensing means, for moving said movable contact from said first fixed contact;

a second fixed contact, contacted by said tripping means after said sensing means senses the presence of an overload condition; and an indicator circuit provided in said neutral line and in series with said input terminal and said load terminal and in parallel with said second fixed contact and said tripping means, said indicator circuit including a light-emitting diode and a capacitor in series with said light-emitting diode;

wherein said light-emitting diode is energized when an overload condition is not sensed.

5. The circuit breaker in accordance with claim 4, wherein said sensing means is a thermally activated bimetallic element.

6. The circuit breaker in accordance with claim 4, wherein said sensing means is magnetically activated.

7. The circuit breaker in accordance with claim 1, wherein only a single capacitor is connected in series with said light-emitting diode.

8. The circuit breaker in accordance with claim 4, wherein only a single capacitor is connected in series with said light-emitting diode.

9. In a conventional circuit breaker provided with a first fixed contact connected to an input terminal, a movable contact provided on a contact arm movable between a closed position directly contacting said first fixed contact and an open position away from said first fixed contact, a load terminal connected to a load through said first fixed and said movable contact during normal operation and disconnected from said first fixed contact during overload operation, sensing means for sensing the presence of an overload condition across the circuit breaker, said sensing means connected to said load terminal, a neutral line connected in series with said load terminal, and a tripping means sensitive to the movement of said sensing means, said tripping means acting to contact a second fixed contact when said sensing means senses an overload condition, the improvement comprising:

an indicator circuit provided in said neutral line and in series with said input terminal and said load terminal and in parallel with said second fixed contact and said tripping means, said indicator circuit including only a single light-emitting diode connected in series to a single capacitor current limiting device, wherein said light-emitting diode operates when an overload condition is not sensed.

* * * * *